US006730131B2

(12) United States Patent
Behler et al.

(10) Patent No.: US 6,730,131 B2
(45) Date of Patent: May 4, 2004

(54) NONIONIC SURFACTANTS

(75) Inventors: Ansgar Behler, Bottrop (DE); Norbert Huebner, Duesseldorf (DE); Alfred Festfechtel, Hilden (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 179 days.

(21) Appl. No.: 10/027,447

(22) Filed: Dec. 20, 2001

(65) Prior Publication Data

US 2002/0155973 A1 Oct. 24, 2002

(30) Foreign Application Priority Data

Dec. 21, 2000 (DE) ..... 100 63 762

(51) Int. Cl.[7] ..... D06L 1/02; C11D 1/72; C11D 1/83; C11D 3/22

(52) U.S. Cl. ..... 8/137; 510/351; 510/353; 510/356; 510/357; 510/358; 510/360; 510/407; 510/413; 510/421; 510/426; 510/470; 510/475; 510/492; 510/535

(58) Field of Search ..... 510/358, 351, 510/353, 356, 357, 360, 407, 413, 421, 426, 470, 475, 492, 535; 8/137

(56) References Cited

U.S. PATENT DOCUMENTS

| | | | | | |
|---|---|---|---|---|---|
| 3,966,629 | A | | 6/1976 | Dumbrell | |
| 4,062,647 | A | | 12/1977 | Storm et al. | |
| 4,153,570 | A | * | 5/1979 | Hennemann et al. | 510/325 |
| 4,737,306 | A | | 4/1988 | Wichelhaus et al. | |
| 4,816,553 | A | | 3/1989 | Baur et al. | |
| 4,820,439 | A | | 4/1989 | Rieck | |
| 5,008,032 | A | | 4/1991 | Diessel et al. | |
| 5,374,716 | A | | 12/1994 | Biermann et al. | |
| 5,417,951 | A | | 5/1995 | Just | |
| 5,576,425 | A | | 11/1996 | Hill et al. | |
| 5,580,941 | A | | 12/1996 | Krause et al. | |
| 5,830,956 | A | | 11/1998 | Stockhausen et al. | |
| 6,551,976 | B1 | * | 4/2003 | Smith et al. | 510/336 |
| 2002/0155973 | A1 | * | 10/2002 | Behler et al. | 510/421 |

FOREIGN PATENT DOCUMENTS

| | | | | |
|---|---|---|---|---|
| DE | 23 34 899 | | 1/1974 | |
| DE | 35 26 405 | | 7/1985 | |
| DE | 42 21 381 | | 2/1994 | |
| DE | 43 00 772 | | 7/1994 | |
| EP | 0 026 529 | | 4/1981 | |
| EP | 0 028 432 | | 5/1981 | |
| EP | 0 164 514 | | 12/1985 | |
| EP | 0 280 223 | | 8/1988 | |
| EP | 0 301 298 | | 2/1989 | |
| EP | 0 367 049 | | 2/1994 | |
| EP | 1217064 | * | 6/2002 | C11D/1/72 |
| WO | WO 90/03977 | | 4/1990 | |
| WO | WO 91/08171 | | 6/1991 | |

* cited by examiner

*Primary Examiner*—Brian P. Mruk
(74) *Attorney, Agent, or Firm*—John E. Drach; Steven J. Trzaska

(57) ABSTRACT

A detergent composition containing a surfactant mixture, the surfactant mixture containing: (a) a nonionic surfactant corresponding to formula (I):

$$R^1O(CH_2CH_2O)_nH \quad (I)$$

wherein $R^1$ is a hydrocarbon radical having from about 16 to 18 carbon atoms and n is a number from about 5 to 10, and wherein the nonionic surfactant has an iodine value of from about 20 to 50; and (b) a co-surfactant selected from the group consisting of an alkyl oligoglycoside, an alkenyl oligoglycoside, an alkyl ether sulfate, and mixtures thereof.

19 Claims, No Drawings

NONIONIC SURFACTANTS

BACKGROUND OF THE INVENTION

The invention is situated in the field of laundry detergents and cleaning products and relates to specific novel unsaturated fatty alcohol polyglycol ethers, to detergent mixtures comprising them, and to their use for producing laundry detergents.

Over recent years, laundry detergents in liquid or gel form have conquered a not inconsiderable market share, since in comparison to powder products they can be used even at low temperatures and are easier to store and dose. For producing such products, there is an increased need for nonionic surfactants, since in contrast to anionic surfactants the nonionic surfactants exhibit an inverse solubility, i.e., are more soluble at low temperatures than at high temperatures. A disadvantage to set against the stated advantages, however, is that liquid products are essentially suitable only for the cleaning of lightly soiled laundry. Stubborn stains in particular, such as makeup or lipstick cannot in practice be removed with common nonionic surfactants, especially at temperatures around 30° C.

The object of the present invention was therefore to provide novel nonionic surfactants which, although sufficiently soluble at low wash temperatures, exhibit improved wash performance specifically with regard to the above-mentioned problem stains.

DESCRIPTION OF THE INVENTION

Subject matter of the invention are novel nonionic surfactants of the formula (I)

$$R^1O(CH_2CH_2O)_nH \quad (I)$$

in which $R^1$ is a hydrocarbon radical having from 16 to 18 carbon atoms and n stands for numbers from 5 to 10, with the proviso that the iodine number of the substances is in the range from 20 to 50.

It has surprisingly been found that these substances, particularly in combination with alkyl and/or alkenyl oligoglycosides and/or alkyl ether sulfates, possess a superior wash performance in comparison to nonionic surfactants of the prior art, especially with regard to lipstick and cosmetic stains.

Nonionic Surfactants

The novel nonionic surfactants are fatty alcohol polyglycol ethers which feature the advantageous combination of specific chain length distribution, iodine number (i.e., degree of unsaturation), and degree of ethoxylation. The surfactants are preferably of the formula (I) in which $R^1$ has the following chain length distribution:

$C_{16}$ saturated: from 55 to 65% by weight
$C_{18}$ saturated: from 2 to 10% by weight
$C_{18}$ monounsaturated: from 25 to 30% by weight
$C_{18}$ di-unsaturated: from 1 to 5% by weight with the proviso that the amounts, together, if desired, with small amounts of shorter-chain or longer-chain homologues, add up to 100% by weight. Particular preference is given to surfactants of the formula (I) in which $R^1$ has the following chain length distribution:

$C_{16}$ saturated: 60% by weight
$C_{18}$ saturated: 5% by weight
$C_{18}$ mono-unsaturated: 28% by weight
$C_{18}$ di-unsaturated: 3% by weight with the proviso that the amounts, together, if desired, with small amounts of shorter-chain or longer-chain homologues, add up to 100% by weight. Fatty alcohol polyglycol ethers of the formula (I) may be obtained in a conventional manner, i.e., by ethoxylating the corresponding unsaturated fatty alcohols. Although it is possible to set an appropriate chain length distribution by mixing different alcohols, it is easier to start directly from the known raw material palm stearin. In this context it has proven particularly advantageous to use nonionic surfactants of the formula (I) in which n stands for 8, which have an iodine number in the range from 30 to 40.

Detergent Mixtures

As already mentioned at the outset, one particular embodiment of the invention consists in utilizing the synergistic boost in washing power when the novel nonionic surfactants are combined with other surface-active substances. A further subject of the invention therefore relates to detergent mixtures comprising (a) nonionic surfactants of the formula (I)

$$R^1O(CH_2CH_2O)_nH \quad (I)$$

in which $R^1$ is a hydrocarbon radical having from 16 to 18 carbon atoms and n stands for numbers from 5 to 10, with the proviso that the iodine number of the substances is in the range from 20 to 50, and (b1) alkyl and/or alkenyl oligoglycosides and/or (b2) alkyl ether sulfates.

Alkyl and/or Alkenyl Oligoglycosides

Alkyl and alkenyl oligoglycosides are known nonionic surfactants which are of the formula (II)

$$R^2O—[G]p \quad (II)$$

in which $R^2$ is an alkyl and/or alkenyl radical having from 4 to 22 carbon atoms, G is a sugar radical having 5 or 6 carbon atoms, and p stands for numbers from 1 to 10. They may be obtained by the relevant processes of preparative organic chemistry. As representatives of the extensive literature, reference may be made here to the documents EP-A1 0301298 and WO 90/03977.

The alkyl and/or alkenyl oligoglycosides may derive from aldoses and/or ketoses having 5 or 6 carbon atoms, preferably from glucose. The preferred alkyl and/or alkenyl oligoglycosides are therefore alkyl and/or alkenyl oligoglucosides. The index p in the general formula (II) indicates the degree of oligomerization (DP), i.e., the distribution of monoglycosides and oligoglycosides, and stands for a number between 1 and 10. While p in a given compound must always be integral and in this case may adopt in particular the values p=1 to 6, p for a particular alkyl oligoglycoside is an analytically determined arithmetic variable which usually represents a fraction. Preference is given to using alkyl and/or alkenyl oligoglycosides having an average degree of oligomerization p of from 1.1 to 3.0. From a performance standpoint, preference is given to alkyl and/or alkenyl oligoglycosides whose degree of oligomerization is less than 1.7 and is in particular between 1.2 and 1.4.

The alkyl and/or alkenyl radical $R^2$ may derive from primary alcohols having from 4 to 11, preferably from 8 to 10, carbon atoms. Typical examples are butanol, caproyl alcohol, caprylyl alcohol, capryl alcohol, and undecyl alcohol, and their technical-grade mixtures, as obtained, for example, in the hydrogenation of technical-grade fatty acid methyl esters or in the course of the hydrogenation of aldehydes from the Roelen oxo process. Preference is given to alkyl oligoglucosides of chain length $C_8$–$C_{10}$ (DP=1 to 3), which are obtained as the initial fraction during the distillative separation of technical-grade $C_8$–$C_{18}$ coconut fatty alcohol and may have an impurities fraction of less than 6% by weight of $C_{12}$ alcohol, and also alkyl oligoglucosides based on technical-grade $C_{9/11}$ oxo alcohols (DP=1 to 3). The alkyl and/or alkenyl radical $R^3$ may also derive from primary alcohols having from 12 to 22, preferably from 12 to 14, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and their technical-grade mixtures, which may be obtained as described above. Preference is given to alkyl oligoglucosides based on hydrogenated $C_{12/14}$ cocoyl alcohol with a DP of from 1 to 3.

Alkyl Ether Sulfates

Alkyl ether sulfates constitute known anionic surfactants which are prepared industrially by sulfation and subsequent neutralization of the corresponding fatty alcohol polyglycol ethers and are preferably of the formula (III)

$$R^3(OCH_2CH_2)_mOSO_3X \quad \text{(III)}$$

in which $R^3$ is an alkyl radical having from 6 to 22, preferably from 12 to 18, carbon atoms, m stands for numbers from 1 to 5, and X is alkali metal, alkaline earth metal, ammonium, alkylammonium, alkanolammonium or glucammonium. Typical examples are the sulfation products of adducts of 2, 3 or 4 mol of ethylene oxide with lauryl alcohol, myristyl alcohol, stearyl alcohol, isostearyl alcohol, behenyl alcohol, and their technical-grade mixtures in the form of the sodium and/or ammonium salts.

The weight ratio between components (a) and (b) may be in the range from 90:10 to 10:90, preferably from 75:25 to 25:75, and in particular from 60:40 to 40:60.

Capacity for Commercial Application

Since a particular advantage of the novel nonionic surfactants lies in their superior washing power specifically with regard to the problem stains of lipsticks and cosmetics, a further subject of the invention relates to their use for producing laundry detergents, especially those in liquid or gel form, in which they may be present in amounts of from 1 to 50%, preferably from 5 to 40%, and in particular from 10 to 30% by weight.

Liquid Laundry Detergents

The laundry detergents in liquid or gel form that are obtainable in the context of the invention using the nonionic surfactant mixtures may have a nonaqueous fraction in the range from 5 to 50% and preferably from 15 to 35% by weight. At their most simple, they comprise aqueous solutions of said surfactant mixtures. The liquid laundry detergents may, however, also comprise substantially water-free compositions. In the context of this invention, "substantially water-free" means that the composition contains preferably no free water which is not bound in the form of water of crystallization or in a comparable form. In certain cases, small amounts of free water can be tolerated, particularly in amounts up to 5% by weight.

Besides said surfactants, the laundry detergents may also comprise other typical ingredients, such as solvents, hydrotropes, bleaches, builders, viscosity regulators, enzymes, enzyme stabilizers, optical brighteners, soil repellents, foam inhibitors, inorganic salts, and also fragrances and dyes, provided they are of sufficient storage stability in the aqueous medium.

Organic Solvents and Hydrotropes

Examples of suitable organic solvents include mono- and/or polyfunctional alcohols having from 1 to 6 carbon atoms, preferably having from 1 to 4 carbon atoms. Preferred alcohols are ethanol, 1,2-propanediol, glycerol, and mixtures thereof. The compositions contain preferably from 2 to 20% by weight and in particular from 5 to 15% by weight of ethanol or any mixture of ethanol and 1,2-propanediol or, in particular, of ethanol and glycerol. It is also possible for the formulations to include, either in addition to the mono- and/or polyfunctional alcohols having from 1 to 6 carbon atoms or alone, polyethylene glycol having a relative molecular mass of between 200 and 2 000, preferably up to 600, in amounts of from 2 to 17% by weight. Examples of hydrotropes which can be used include toluenesulfonate, xylenesulfonate, cumenesulfonate or mixtures thereof.

Bleaches

Among the compounds used as bleaches which yield hydrogen peroxide in water, particular importance is possessed by sodium perborate tetrahydrate and sodium perborate monohydrate. Further bleaches are, for example, peroxycarbonate, citrate perhydrates, and salts of peracids, such as perbenzoates, peroxyphthalates or diperoxydodecanedioic acid. They are normally used in amounts of from 8 to 25% by weight. Preference is given to the use of sodium perborate monohydrate in amounts of from 10 to 20% by weight and in particular from 10 to 15% by weight. Through its ability to be able to bind free water, with formation of the tetrahydrate, it contributes to increasing the stability of the composition. Preferably, however, the formulations are free from such bleaches.

Builders

Suitable builders are ethylenediaminetetraacetic acid, nitrilotriacetic acid, citric acid, and inorganic phosphonic acids, such as, for example, the neutral sodium salts of 1-hydroxyethane-1,1,-diphosphonate, which may be present in amounts of from 0.5 to 5%, preferably from 1 to 2% by weight.

Viscosity Regulators

Examples of viscosity regulators which can be used include hydrogenated castor oil, salts of long-chain fatty acids, which are used preferably in amounts of from 0 to 5% by weight and in particular in amounts of from 0.5 to 2% by weight, examples being sodium, potassium, aluminum, magnesium and titanium stearates or the sodium and/or potassium salts of behenic acid, and also further polymeric compounds. The latter include preferably polyvinylpyrrolidone, urethanes, and the salts of polymeric polycarboxylates, examples being homopolymeric or copolymeric polyacrylates, polymethacrylates and, in particular, copolymers of acrylic acid with maleic acid, preferably those comprising 50% to 10% maleic acid. The relative molecular mass of the homopolymers is generally between 1 000 and 100 000, that of the copolymers between 2 000 and 200 000, preferably between 50 000 to 120 000, based on the free acid. Also suitable in particular are water-soluble polyacrylates which are crosslinked, for example, with about 1% of a polyallyl ether of sucrose and possess a relative molecular mass of more than one million. Examples thereof are the polymers having a thickening action which are obtainable under the name CARBOPOL® 940 and 941. The crosslinked polyacrylates are used preferably in amounts not more than 1% by weight, preferably in amounts of from 0.2 to 0.7% by weight. The compositions may further comprise from about 5 to 20% by weight of a partially esterified copolymer as described in the European patent application EP-A1 0367049. These partially esterified polymers are obtained by copolymerizing (a) at least one $C_4$–$C_{28}$ olefin or mixtures of at least one $C_4$–$C_{28}$ olefin with up to 20 mol % of $C_1$–$C_{28}$ alkyl vinyl ethers and (b) ethylenically unsaturated dicarboxylic anhydrides having from 4 to 8 carbon atoms in a molar ratio of 1:1 to give copolymers having K values of from 6 to 100 and then partially esterifying the copolymers with reaction products such as $C_1$–$C_{13}$ alcohols, $C_8$–$C_{22}$ fatty acids, $C_1$–$C_{12}$ alkylphenols, secondary $C_2$–$C_{30}$ amines or mixtures thereof with at least one $C_2$–$C_4$ alkylene oxide or tetrahydrofuran, and hydrolyzing the anhydride groups of the copolymers to carboxyl groups, the partial esterification of the copolymers being conducted to an extent such that from 5 to 50% of the carboxyl groups of the copolymers are esterified. Preferred copolymers comprise maleic anhydride as ethylenically unsaturated dicarboxylic anhydride. The partially esterified copolymers then may be present either in the form of the free acid or, preferably, in partly or fully neutralized form. Advantageously, the copolymers are used in the form of an aqueous solution, in particular in the form of a solution with a strength of from 40 to 50% by weight. The copolymers not only make a contribution to the primary and secondary wash performance of the liquid laundry detergent and cleaning product but also bring about a desired reduction in viscosity of the concentrated liquid laundry detergents. Through the use of these partially esterified copolymers, concentrated aqueous liquid laundry detergents are obtained which are flowable under the influence of gravity alone and without the action of other shearing forces. Preferably, the concentrated aqueous liquid laundry detergents contain partially esterified copolymers in amounts of from 5 to 15% by weight and in particular in amounts of from 8 to 12% by weight.

Enzymes

Suitable enzymes include those from the class of the proteases, lipases, amylases, cellulases, and mixtures of these. Especially suitable active enzymatic substances are those obtained from bacterial strains or fungi, such as *Bacillus subtilis, Bacillus licheniformis,* and *Streptomyces griseus.* It is preferred to use proteases of the subtilisin type, and especially proteases obtained from *Bacillus lentus.* Their fraction may be from about 0.2 to about 2% by weight. The enzymes may be adsorbed on carrier substances and/or embedded in coating substances in order to protect them against premature decomposition. In addition to the monofunctional and polyfunctional alcohols, and the phosphonates, the compositions may comprise further enzyme stabilizers. For example, from 0.5 to 1% by weight of sodium formate may be used. Also possible is the use of proteases stabilized with soluble calcium salts, with a calcium content of preferably about 1.2% by weight, based on the enzyme. However, it is particularly advantageous to employ boron compounds, examples being boric acid, boron oxide, borax and other alkali metal borates such as the salts of orthoboric acid ($H_3BO_3$), of metaboric acid ($HBO_2$), and of pyroboric acid (tetraboric acid, $H_2B_4O_7$).

Soil Repellents

Suitable dirt-repelling polymers (soil repellents) include those substances which preferably contain ethylene terephthalate and/or polyethylene glycol terephthalate groups, it being possible for the molar ratio of ethylene terephthalate to polyethylene glycol terephthalate to be situated within the range from 50:50 to 90:10. The molecular weight of the linking polyethylene glycol units is situated in particular in the range from 750 to 5 000, i.e., the degree of ethoxylation of the polymers containing polyethylene glycol groups can be from about 15 to 100. The polymers feature an average molecular weight of about 5 000 to 200 000 and may have a block structure, though preferably have a random structure. Preferred polymers are those having ethylene terephthalate/polyethylene glycol terephthalate molar ratios of from about 65:35 to about 90:10, preferably from about 70:30 to 80:20. Preference is also given to those polymers which have linking polyethylene glycol units with a molecular weight of from 750 to 5 000, preferably from 1 000 to about 3 000, and with a molecular weight of the polymer of from about 10 000 to about 50 000. Examples of commercial polymers are the products MILEASE® T (ICI) or REPELOTEX® SRP 3 (Rhône-Poulenc).

Foam Inhibitors

In the case of use in machine laundering, it may be of advantage to add customary foam inhibitors to the compositions. Examples of compounds suitable for this purpose include soaps of natural or synthetic origin containing a high proportion of $C_{18}$–$C_{24}$ fatty acids. Examples of suitable nonsurfactant-like foam inhibitors are organopolysiloxanes and their mixtures with microfine silica, which may have been silanized, and also paraffins, waxes, microcrystalline waxes, and their mixtures with silanized silica or bistearylethylenediamide. With advantages, use is also made of mixtures of different foam inhibitors, e.g., those comprising silicones, paraffins or waxes. The foam inhibitors, especially silicone or paraffin foam inhibitors, are preferably attached to a granular carrier substance which is soluble or dispersible in water. Particular preference is given here to mixtures of paraffins and bistearylethylenediamides.

The pH of the compositions of the invention and particularly preferred concentrated compositions is generally from 7 to 10.5, preferably from 7 to 9.5, and in particular from 7 to 8.5. Higher pH values, of more than 9, for example, may be set by using small amounts of sodium hydroxide or of alkaline salts such as sodium carbonate or sodium silicate. The liquid laundry detergents of the invention generally have viscosities of between 150 and 10 000 mPas (Brookfield viscometer, spindle 1, 20 revolutions per minute, 20° C). In the case of the substantially water-free compositions, viscosities of between 150 and 5 000 mPas are preferred. The viscosity of the aqueous compositions is preferably between 2 000 mPas and in particular is between 150 and 1 000 mPas.

Powder Laundry Detergents

Where the nonionic surfactants of the invention are used for producing powder laundry detergents, they may comprise, in addition to said surfactants, further typical ingredients, such as builders, bleaches, bleach activators, detergency boosters, enzymes, enzyme stabilizers, graying inhibitors, optical brighteners, soil repellents, foam inhibitors, inorganic salts, and fragrances and dyes, for example. A number of these classes of substance have already been elucidated in the section "Liquid laundry detergents".

Solid Builders

As solid builders, use is made in particular of finely crystalline, synthetic zeolites containing bound water, such as zeolite NaA in laundry detergent grade. Also suitable, however, are zeolite NaX and mixtures of NaA and NaX. The zeolite may be employed in the form of spray-dried powder or else as an undried (still wet from its preparation), stabilized suspension. Where the zeolite is used in suspension form, said suspension may include small additions of nonionic surfactants as stabilizers: for example, from 1 to 3% by weight, based on zeolite, of ethoxylated $C_{12}$–$C_{18}$ fatty alcohols having from 2 to 5 ethylene oxide groups or ethoxylated isotridecanols. Suitable zeolites have an average particle size of less than 10 $\mu$m (volume distribution; measurement method: Coulter counter) and contain preferably from 18 to 22% by weight, in particular from 20 to 22% by weight, of bound water. Suitable substitutes or partial substitutes for zeolites are crystalline, layered sodium silicates of the general formula $NaMSi_xO_{2x+1}\cdot yH_2O$, where M is sodium or hydrogen, x is a number from 1.9 to 4 and y is a number from 0 to 20, and preferred values for x are 2, 3 or 4. Crystalline phyllosilicates of this kind are described, for example, in the European patent application EP-A1 0164514. Preferred crystalline phyllosilicates are those in which M in the general formula is sodium and x adopts the value 2 or 3. In particular, both β- and γ-sodium disilicates $Na_2Si_2O_5\cdot yH_2O$ are preferred, β-sodium disilicate, for example, being obtainable by the process described in the international patent application WO 91/08171. The powder laundry detergents of the invention preferably comprise, as solid builders, from 10 to 60% by weight of zeolite and/or crystalline phyllosilicates, and mixtures of zeolite and crystalline phyllosilicates in an arbitrary ratio may be particularly advantageous. In particular it is preferred for the compositions to contain from 20 to 50% by weight of zeolite and/or crystalline phyllosilicates. Particularly preferred compositions contain up to 40% by weight of zeolite and in particular up to 35% by weight of zeolite, based in each case on anhydrous active substance. Further suitable ingredients of the compositions are water-soluble amorphous silicates; preferably, they are used in combination with zeolite and/or crystalline phyllosilicates. Particular preference is given to compositions containing, in particular, sodium silicate with a molar ratio (modulus) $Na_2O:SiO_2$ of from 1:1 to 1:4.5, preferably from 1:2 to 1:3.5. The amount of amorphous sodium silicates in the compositions is preferably up to 15% by weight and preferably between 2 and 8% by weight. Phosphates such as tripolyphosphates, pyrophosphates and orthophosphates, as well, may be present in small amounts in the compositions. The phosphate content of the compositions is preferably up to 15% by weight, but in particular from 0 to 10% by weight. Moreover, the compositions may also comprise, additionally, phyllosilicates of natural and synthetic origin. Such phyllosilicates are known, for example, from the patent applications DE-C1 2334899, EP-A1 0026529 and DE-A1 3526405. Their usefulness is not restricted to a specific composition or structural formula. However, preference is given here to smectites, especially bentonites. Suitable phyllosilicates which belong to the group of the water-swellable smectites include, for example, those of the general formulae

| | |
|---|---|
| $(OH)_4Si_{8-y}Al_y(Mg_xAl_{4-x})O_{20}$ | montmorrilonite |
| $(OH)_4Si_{8-y}Al_y(Mg_{6-z}Li_z)O_{20}$ | hectorite |
| $(OH)_4Si_{8-y}Al_y(Mg_{6-z}Al_z)O_{20}$ | saponite |

where x=0 to 4, y=0 to 2, z=0 to 6. Moreover, small amounts of iron may be incorporated into the crystal lattice of the phyllosilicates in accordance with the above formulae. Moreover, on the basis of their ion exchange properties, the phyllosilicates may contain hydrogen, alkali metal and/or alkaline earth metal ions, especially $Na^+$ and $Ca^{2+}$. The amount of water in hydrate form is generally in the range from 8 to 20% by weight and is dependent on the state of swelling and/or on the nature of processing. Phyllosilicates which can be used are known, for example, from U.S. Pat. Nos. 3,966,629, 4,062,647, EP-A 0026529 and EP-A 0028432. It is preferred to use phyllosilicates which owing to an alkali treatment are substantially free of calcium ions and strongly coloring iron ions. Useful organic builder substances are, for example, the polycarboxylic acids, which are preferably used in the form of their sodium salts, such as citric acid, adipic acid, succinic acid, glutaric acid, tartaric acid, sugar acids, amino carboxylic acids, nitrilotriacetic acid (NTA), provided such use is not objectionable on environmental grounds, and also mixtures of these. Preferred salts are the salts of the polycarboxylic acids such as citric acid, adipic acid, succinic acid, glutaric acid, tartaric acid, sugar acids, and mixtures thereof. Suitable polymeric polycarboxylates are, for example, the sodium salts of polyacrylic acid or of polymethacrylic acid, examples being those having a relative molecular mass of from 800 to 150 000 (based on acid). Particularly suitable copolymeric polycarboxylates are those of acrylic acid with methacrylic acid and of acrylic acid or methacrylic acid with maleic acid. Copolymers of acrylic acid with maleic acid, containing from 50 to 90% by weight acrylic acid and from 50 to 10% by weight maleic acid, have proven particularly suitable. Their relative molecular mass, based on free acids, is generally from 5 000 to 200 000, preferably from 10 000 to 120 000, and in particular from 50 000 to 100 000. The use of polymeric polycarboxylates is not absolutely necessary. If, however, polymeric polycarboxylates are used, then compositions are preferred which comprise biodegradable polymers, examples being terpolymers whose monomers are acrylic acid and maleic acid and/or salts thereof and also vinyl alcohol and/or vinyl alcohol derivatives or whose monomers are acrylic acid and 2-alkylarylsulfonic acid and/or salts thereof, and also sugar derivatives. Particular preference is given to terpolymers obtained in accordance with the teaching of the German patent applications DE-A1 4221381 and DE-A1 4300772. Further suitable builder substances are polyacetals, which may be obtained by reacting dialdehydes with polyolcarboxylic acids having from 5 to 7 carbon atoms and at least 3 hydroxyl groups, as described for example in the European patent application EP-A1 0280223. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Bleach Activators

In order to achieve an improved bleaching action when washing at temperatures of 60° C. and below, it is possible to incorporate bleach activators into the preparations. Examples thereof are N-acyl and/or O-acyl compounds, preferably N,N'-tetraacylated diamines, which form organic peracids with hydrogen peroxide, and also carboxylic anhydrides and esters of polyols such as glucose pentaacetate. The amount of bleach activators in the compositions comprising bleach is within the customary range, preferably between 1 and 10% by weight and in particular between 3 and 8% by weight. Particularly preferred bleach activators are N,N,N',N'-tetraacetylethylenediamine and 1,5-diacetyl-2,4-dioxohexahydro-1,3,5-triazine.

Graying Inhibitors

Graying inhibitors have the function of keeping the soil detached from the fiber in suspension in the liquor and so preventing graying. Suitable for this purpose are water-soluble colloids, usually organic in nature, examples being the water-soluble salts of polymeric carboxylic acids, glue, gelatin, salts of ether carboxylic acids or ether sulfonic acids of starch or of cellulose, or salts of acidic sulfuric esters of cellulose or of starch. Water-soluble polyamides containing acidic groups are also suitable for this purpose. Furthermore, use may be made of soluble starch preparations and starch products other than those mentioned above, examples being degraded starch, aldehyde starches, etc. Polyvinylpyrrolidone as well can be used. However, it is preferred to use cellulose ethers, such as carboxymethylcellulose, methylcellulose, hydroxyalkylcellulose, and mixed ethers, such as methylhydroxyethylcellulose, methylhydroxypropylcellulose, methylcarboxymethylcellulose and mixtures thereof, and also polyvinylpyrrolidone, for example, in amounts of from 0.1 to 5% by weight, based on the compositions.

Optical Brighteners

As optical brighteners the compositions may comprise derivatives of diaminostilbenedisulfonic acid and/or alkali metal salts thereof. Suitable, for example, are salts of 4,4'-bis(2-anilino-4-morpholino-1,3,5-triazinyl-6-amino) stilbene-2,2'-disulfonic acid or compounds of similar structure which instead of the morpholino group carry a diethanolamino group, a methylamino group, an anilino group, or a 2-methoxyethylamino group. It is possible for brighteners of the substituted diphenylstyryl type to be present, examples being the alkali metal salts of 4,4'-bis(2-sulfostyryl)biphenyl, 4,4'-bis(4-chloro-3-sulfostyryl) biphenyl or 4-(4-chlorostyryl)-4'-(2-sulfostyryl)biphenyl. Mixtures of the aforementioned brighteners may also be used. Uniformly white granules are obtained if, in addition to the customary brighteners in customary amounts, examples being between 0.1 and 0.5% by weight, preferably between 0.1 and 0.3% by weight, the compositions also include small amounts, examples being from $10^{-6}$ to $10^{-3}$% by weight, preferably around $10^{-5}$% by weight, of a blue dye. One particularly preferred dye is TINOLUX® (commercial product from Ciba-Geigy).

EXAMPLES

The wash performance of three different gel formulations was investigated, in a washing machine of Miele 918 type, with regard to different stains and fabrics. The liquor load was 3.5 kg of standard laundry, the wash temperature 30° C. (30 minutes delicates program, the water hardness 16° dH [German hardness]. The formulations were used in a concentration of 3 g/l and the wash performance was determined by photometry against a white standard (barium sulfate). The results are compiled in table 1. Example 1 is inventive, examples C1 and C2 serve for comparison. A deviation of 3 reflectance units is regarded as being significant.

TABLE 1

Composition and performance of laundry detergent gels (amounts as % by weight)

| | 1 | C1 | C2 |
|---|---|---|---|
| Composition/performance | | | |
| Palm stearyl alcohol + 8EO (IN = 37) | 25 | — | — |
| Cetyl stearyl alcohol + 8EO (IN = 52) | — | 25 | — |
| Coconut alcohol + 7EO | — | — | 25 |
| Sodium laureth sulfate | 5 | 5 | 5 |
| Cocoglucosides | 3 | 3 | 3 |
| Lauric acid | 9 | 9 | 9 |
| Palmitic acid | 7 | 7 | 7 |
| Sodium citrate | 4 | 4 | 4 |
| Water | | ad 100 | |
| Wash performance [% reflectance] | | | |
| Dust/sebum on polyester | 75 | 73 | 74 |
| Dust/sebum on cotton | 72 | 72 | 71 |
| Dust/sebum on poly/cotton finished | 79 | 78 | 77 |
| Makeup on poly/cotton finished | 82 | 73 | 78 |
| Lipstick on poly/cotton finished | 72 | 64 | 67 |
| Soot/olive oil on cotton | 32 | 31 | 31 |
| Soot/mineral oil on poly/cotton finished | 41 | 40 | 41 |
| Red wine on cotton | 64 | 63 | 63 |

What is claimed is:

1. A detergent composition comprising a surfactant mixture, the surfactant mixture containing:

(a) a nonionic surfactant corresponding to formula (I):

$$R^1O(CH_2CH_2O)_nH \quad (I)$$

wherein $R^1$ is a hydrocarbon radical having from about 16 to 18 carbon atoms and n is a number from about 5 to 10, and wherein the nonionic surfactant has an iodine value of from about 20 to 50, and a carbon chain length distribution corresponding to:

(i) from about 55 to 65% by weight of $C_{16}$ saturated;

(ii) from about 2 to 10% by weight of $C_{18}$ saturated;

(iii) from about 25 to 30% by weight of $C_{18}$ monounsaturated; and (iv) from about 1 to 5% by weight of $C_{18}$ di-unsaturated, with the proviso that the amounts, together with small amounts of shorter-chain and/or longer-chain homologues, added up to 100% by weight; and (b) a co-surfactant selected from the group consisting of an alkyl oligoglycoside, an alkenyl oligoglycoside, an alkyl ether sulfate, and mixtures thereof.

2. The composition of claim 1 wherein the nonionic surfactant has the following carbon chain length distribution:

(a) about 60% by weight of $C_{16}$ saturated;

(b) about 5% by weight of $C_{18}$ saturated:

(c) about 28% by weight of $C_{18}$ mono-unsaturated; and (d) about 3% by weight of $C_{18}$ di-unsaturated, with the proviso that the amounts, together with small amounts of shorter-chain and/or longer-chain homologues, add up to 100% by weight.

3. The composition of claim 1 wherein the nonionic surfactant is derived from a palm stearin raw material.

4. The composition of claim 1 wherein in formula (I), n is 8.

5. The composition of claim 1 wherein the nonionic surfactant has an iodine value of from about 30 to 40.

6. The composition of claim 1 wherein the nonionic surfactant and co-surfactant are present in the composition in a ratio by weight of from about 60:40 to 40:60.

7. The composition of claim 1 wherein the surfactant mixture is present in the composition in an amount of from about 1 to 50% by weight, based on the weight of the composition.

8. The composition of claim 1 wherein the surfactant mixture is present in the composition in an amount of from about 5 to 40% by weight, based on the weight of the composition.

9. The composition of claim 1 wherein the composition contains about 5% by weight, based on the weight of the composition, of water.

10. A process for enhancing cold water solubility of a laundry detergent comprising adding a surfactant mixture to the laundry detergent, the surfactant mixture containing:

(a) a nonionic surfactant corresponding to formula (I):

$$R^1O(CH_2CH_2O)_nH \quad (I)$$

wherein $R^1$ is a hydrocarbon radical having from about 16 to 18 carbon atoms and n is a number from about 5 to 10, and wherein the nonionic surfactant has an iodine value of from about 20 to 50, and having a carbon chain length distribution corresponding to:

(i) from about 55 to 65% by weight of $C_{16}$ saturated;

(ii) from about 2 to 10% by weight of $C_{18}$ saturated;

(iii) from about 25 to 30% by weight of $C_{18}$ monounsaturated; and (iv) from about 1 to 5% by weight of $C_{18}$ di-unsaturated, with the proviso that the amounts, together with small amounts of shorter-chain and/or longer-chain homologues, add up to 100% by weight; and (b) a co-surfactant selected from the group consisting of an alkyl oligoglycoside, an alkenyl oligoglycoside, an alkyl ether sulfate, and mixtures thereof.

11. The process of claim 10 wherein the nonionic surfactant has the following carbon chain length distribution:

(a) about 60% by weight of $C_{16}$ saturated;

(b) about 5% by weight of $C_{18}$ saturated;

(c) about 28% by weight of $C_{18}$ mono-unsaturated; and (d) about 3% by weight of $C_{18}$ di-unsaturated, with the proviso that the amounts, together with small amounts of shorter-chain and/or longer-chain homologues, add up to 100% by weight.

12. The process of claim 10 wherein the nonionic surfactant is derived from a palm stearin raw material.

13. The process of claim 10 wherein in formula (I), n is 8.

14. The composition of claim 10 wherein the nonionic surfactant has an iodine value of from about 30 to 40.

15. The process of claim 10 wherein the nonionic surfactant and co-surfactant are present in the composition in a ratio by weight of from about 60:40 to 40:60.

16. The process of claim 10 wherein the surfactant mixture is added to the composition in an amount of from about 1 to 50% by weight, based on the weight of the composition.

17. The process of claim 10 wherein the surfactant mixture is added to the composition in an amount of from about 5 to 40% by weight, based on the weight of the composition.

18. The process of claim 10 wherein the composition contains about 5% by weight, based on the weight of the composition, of water.

19. A process for cleaning textiles comprising contacting the textiles with a laundry detergent composition containing a surfactant mixture, the surfactant mixture comprising:

(a) a nonionic surfactant corresponding to formula (I):

$$R^1O(CH_2CH_2O)_nH \quad (I)$$

wherein $R^1$ is a hydrocarbon radical having from about 16 to 18 carbon atoms and n is a number from about 5 to 10, and wherein the nonionic surfactant has an iodine value of from about 20 to 50, and having a carbon chain length distribution corresponding to:

(i) from about 55 to 65% by weight of $C_{16}$ saturated;

(ii) from about 2 to 10% by weight of $C_{18}$ saturated;

(iii) from about 25 to 30% by weight of $C_{18}$ monoun-saturated; and (iv) from about 1 to 5% by weight of $C_{18}$ di-unsaturated, with the proviso that the amounts, together with small amounts of shorter-chain and/or longer-chain homologues, add up to 100% weight; and (b) a co-surfactant selected from the group consisting at an alkyl oligoglycoside, an alkenyl oligoglycoside an alkyl ether sulfate, and mixtures thereof.

* * * * *